US006783325B1

(12) United States Patent
Hileman et al.

(10) Patent No.: US 6,783,325 B1
(45) Date of Patent: Aug. 31, 2004

(54) HIGH AIR FLOW FAN TRAY BRACKET

(75) Inventors: Vince P. Hileman, Fremont, CA (US); Robert J. Lajara, San Jose, CA (US); Thomas E. Stewart, Saratoga, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 113 days.

(21) Appl. No.: 10/109,761

(22) Filed: Mar. 29, 2002

(51) Int. Cl.[7] ..... F04D 29/52
(52) U.S. Cl. ..... 415/213.1; 415/220
(58) Field of Search ..... 415/213.1, 121.2, 415/220, 214.1; 361/695

(56) References Cited

U.S. PATENT DOCUMENTS 4,834,615 A * 5/1989 Mauch et al. ..... 415/213.1
5,788,566 A * 8/1998 McAnally et al. ..... 415/213.1
5,852,547 A * 12/1998 Kitlas et al. ..... 361/695
6,086,476 A * 7/2000 Paquin et al. ..... 361/695
6,213,819 B1 * 4/2001 Fan ..... 361/695
6,236,564 B1 * 5/2001 Fan ..... 415/213.1

* cited by examiner

*Primary Examiner*—Edward K. Look
*Assistant Examiner*—Igor Kershteyn
(74) *Attorney, Agent, or Firm*—Meyertons Hood Kivlin Kowert & Goetzel, P.C.; B. Noël Kivlin

(57) ABSTRACT

The disclosed system is directed towards a tray bracket. The tray bracket comprises a tray bracket inlet, the tray bracket inlet has tray bracket inlet coupling elements. A tray bracket outlet is coupled to the tray bracket inlet and the tray bracket outlet has a body. The tray bracket includes a plurality of tray bracket outlet passages contiguous with the body. The plurality of tray bracket outlet passages are aligned with fan passages of at least one fan unit. The tray bracket outlet passages and the fan passages provide low impedance to air flow and low noise. The tray bracket includes attaching mechanisms contiguous with the body. The attaching mechanisms are manually demountably coupled to the tray bracket inlet coupling elements.

22 Claims, 5 Drawing Sheets

HIGH AIR FLOW FAN TRAY BRACKET

FIELD OF THE DISCLOSURE

The present disclosure relates to air cooling units for network computer systems and more particularly a fan tray bracket for fan driven air cooling units.

BACKGROUND

Devices for cooling network equipment are well known in the art. Conventional methods utilize either air cooling across the face of the network equipment or liquid cooling circulating liquid within a heat exchanger attached to the equipment. While the process of liquid cooling is effective, higher operating costs result due to higher electrical power needs, expensive dielectric coolants which pose safety hazards, and substantial amounts of mechanical parts. Therefore, the preferred method is air cooling. However, air cooling also has several drawbacks.

In order to air cool network equipment, while complying with UL safety standards, a fan unit assembly is generally utilized. This fan unit assembly is equipped with an air mover, such as a fan, air filters and a guard to protect appendages from the circular motion of the fan. While the device protects the operator, the guard can impede the volume of air flow, thereby reducing product efficiency and increasing costs.

The conventional design of the blade tips relative to the inlet grill of the fan can be another drawback to air cooling. Most fans are made of hard material, having sharp edges such as metal. While in operation, the fan produces a high amount of acoustical noise due to blade-pass noise, which is a function of the fan speed and the number of blades and proximate surfaces to the blades. There are industry standards restricting the amount of noise produced as well as the concept that excessive noise is undesirable.

Another drawback is the design of the fan unit assembly itself. Conventional designs have obstructions such as the fan struts, which impede air flow through the fan unit. The obstructions reduce cross sectional flow area which restricts mass flow rates and subsequently reduce efficiency.

Conventional designs incorporate assembly features that are costly and time consuming both in the assembly process as well as in post installation maintenance procedures, such as filter replacement. This can bee due to an excessive quantity of mechanical assembly parts used to assemble the fan unit assembly and attach the fan unit assembly to the network system as well as the location of the components.

What is needed in the art is a fan unit assembly that has features in which airflow is not impeded, assembly and disassembly is simplified and cost of assembly and maintenance is reduced while improving safety.

SUMMARY OF THE DISCLOSED SYSTEM

The disclosed system is directed towards a tray bracket. The tray bracket comprises a tray bracket inlet, the tray bracket inlet has tray bracket inlet coupling elements. A tray bracket outlet is coupled to the tray bracket inlet and the tray bracket outlet has a body. The tray bracket includes a plurality of tray bracket outlet passages contiguous with the body. The plurality of tray bracket outlet passages are aligned with fan passages of at least one fan unit. The tray bracket outlet passages and the fan passages provide low impedance to air flow and low noise. The tray bracket includes attaching means contiguous with the body. The attaching means are manually demountably coupled to the tray bracket inlet coupling elements.

DETAILED DESCRIPTION OF THE DISCLOSURE

Those of ordinary skill in the art will realize that the following description of the present disclosed system is illustrative only and not in any way limiting. Other embodiments of the disclosed system will readily suggest themselves to such skilled persons.

Figure 1:
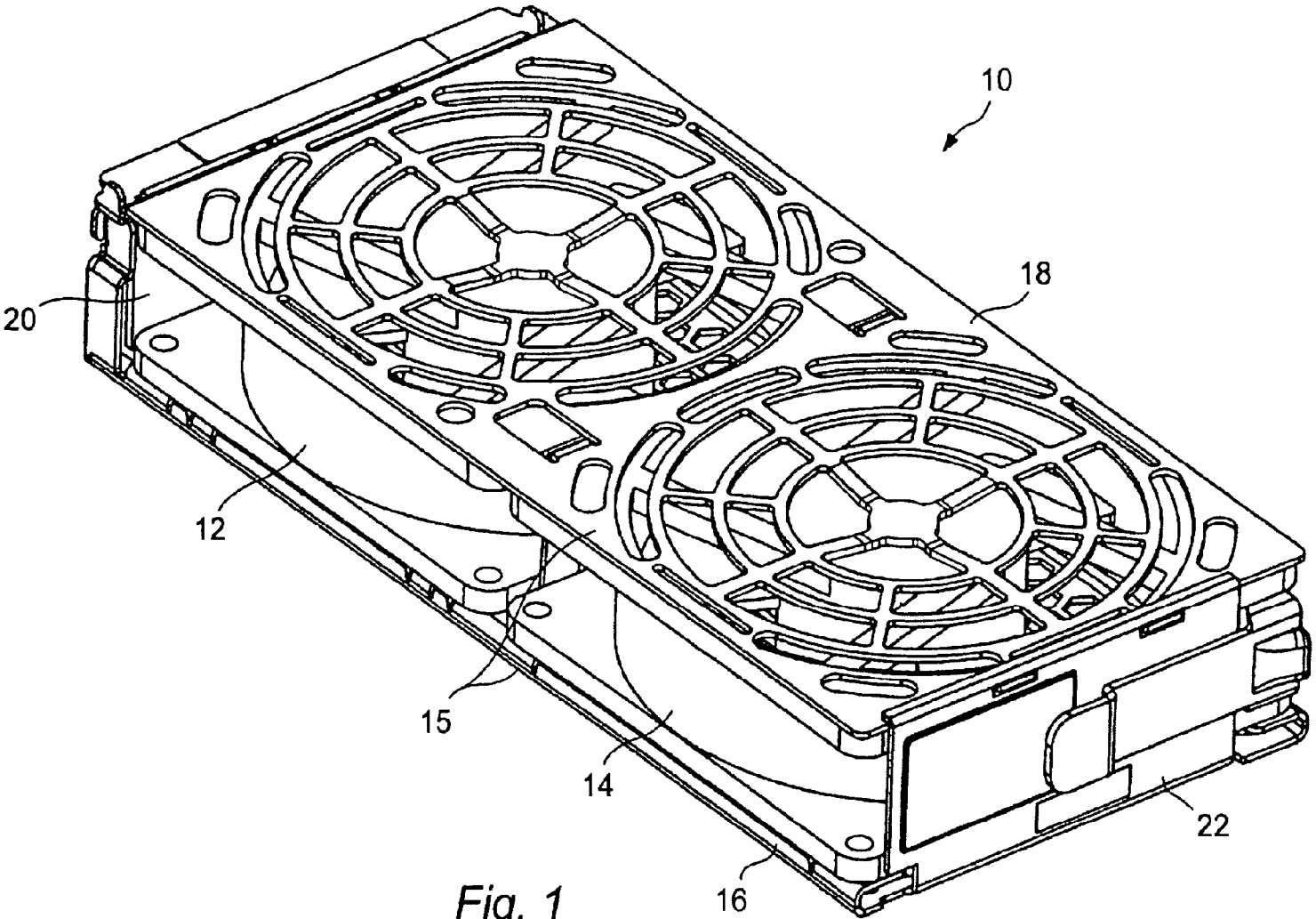
FIG. 1 is a drawing of an exemplary embodiment of a fan tray bracket with a fan unit assembly.
Figure 2:
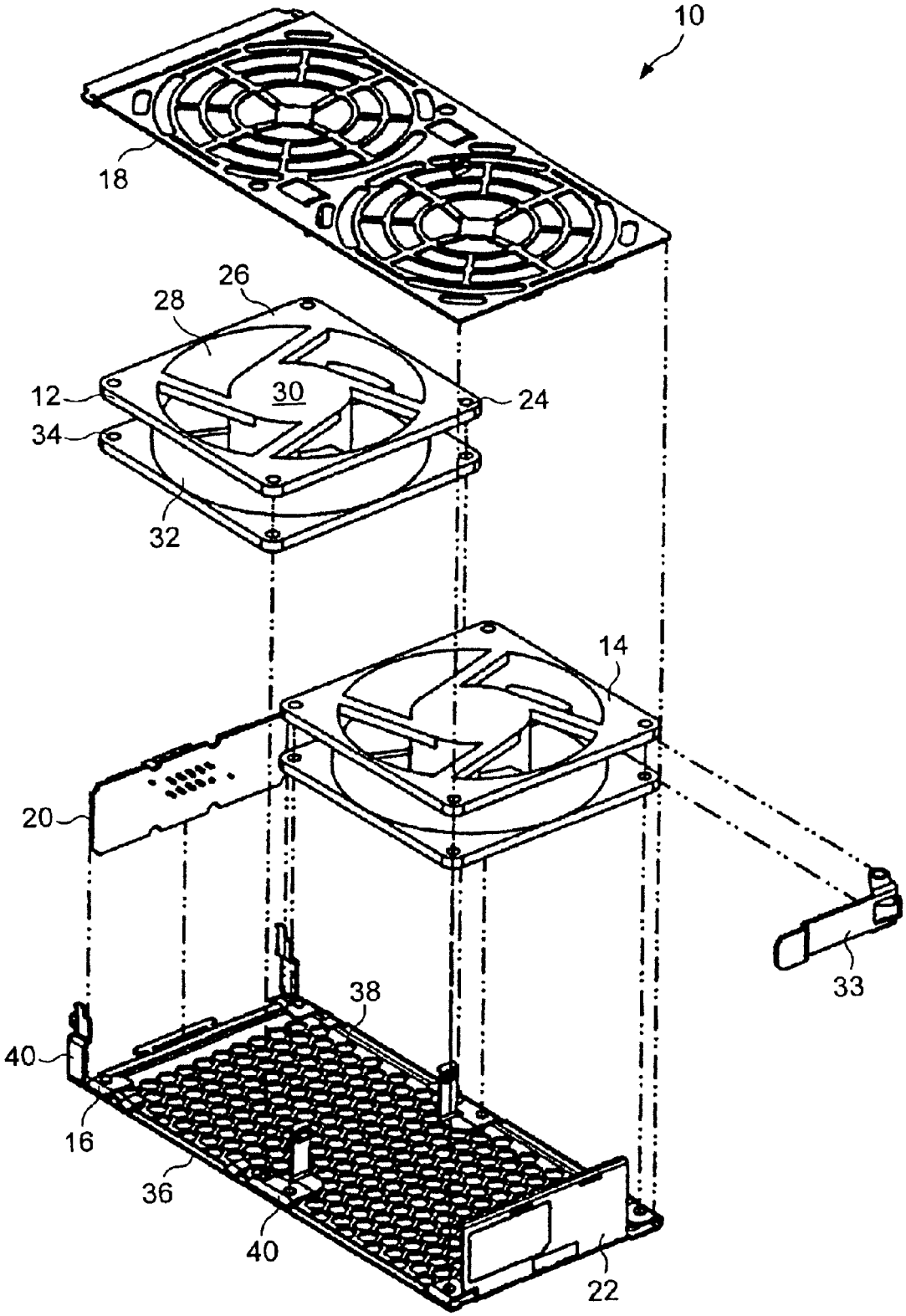
FIG. 2 is an exploded perspective view of an exemplary fan unit assembly.

Referring to FIGS. 1 and 2, an exemplary embodiment of an assembled fan unit assembly 10 is illustrated and an exploded view of the fan unit assembly 10 is also illustrated. Fan units are insertable into network computer systems for the purpose of providing ambient cooling air into the system to convectively remove excess thermal energy generated within the system. The fan unit assembly 10 operates utilizing forced air convection, in which the air mover draws ambient air from outside the network system and pushes the air through the network system across and around the heated surfaces of components in the network system. The air having transferred the thermal energy from the heated components is exhausted out of the network system. To improve the efficiency, cooling capacity and noise quality some variables such as inlet air temperature, and mass flow rate and blade to obstruction proximity can be modified. Generally, the ambient air temperature is a variable that cannot be altered since the ambient air is at room temperature and not readily altered. Therefore it is a variable that is not altered in order to improve the cooling capacity of the network system. However, the mass flow rate of the air through the network system is a variable that can be altered in order to improve the cooling of the network system. Increasing the mass flow rate of air through the system has limitations such as, flow area, fan unit power consumption (size and speed), and noise generation. Improvements to the fan unit assembly 10 can greatly improve the cooling capacity for the network system. This disclosure provides improvements to the cooling capacity and efficiency of network computer systems while maintaining lower noise generation without increasing fan unit power consumption or network computer system areas.

Referring to FIGS. 1 and 2, the fan unit assembly 10 may be comprised of a fan unit 12 or simply fan 12, or multiple fan units 12 and 14 in some embodiments. The fans 12 and 14 are mountable inside an arrangement of a fan tray bracket 15 comprising a tray bracket inlet 16 and a tray bracket outlet 18. In another embodiment the fans 12, 14 can be encased between the tray bracket inlet 16 and the tray bracket outlet 18 as well as a first side 20 and a second side 22. The first side 20 and second side 22 are coupled between the tray bracket inlet 16 and the tray bracket outlet 18. The first side 20 can be a printed circuit board that includes the circuitry for the fans 12, 14. In some embodiments, the tray bracket inlet 16 or the tray bracket outlet 18 may incorporate the first side 20 and/or the second side 22, such that all three components are contiguous. As depicted, the fans 12, 14 are mountable along a single plane in a side by side arrangement. In alternative embodiments, the fans can be oriented along different planes, as well as situated adjacent to and orthogonal to and/or offset to each other.

Referring now to FIG. 2, the following description and numerals of the fan units 12 and 14 are referenced in FIG. 2 only to fan unit 12, although not explicitly shown, the components referenced for fan unit 12 also apply to fan unit 14. The fan units 12 and 14 can be motor driven axial fans encased in a housing 24. The housing 24 is a rectilinear shape having at least one face 26 that is planar and arranged substantially parallel in separate planes. The faces 26 form passages 28 that provide a flow area or passages for air to flow though. In the embodiment illustrated at FIG. 2, the faces 26 have four substantially triangular shaped passages 28 arranged symmetrically about a solid circular shaped central portion 30 or simply hub 30. The passages 28 fluidly communicate with fan blades (not shown) of the fans 12 and 14 and permit air propelled by the fan blades to flow through the fans 12, 14 and are the primary air flow areas (or air flow paths) into and out of the fans 12, 14. The central portion 30 does not permit air to flow and serves to enclose one end of a motor (not shown) encased within the housing 24. A casing 32, having a cylindrical shape, is coupled between the two faces 26, thus supporting the fan blades and enclosing the motor and to provide a closed flow path for the air through the fan units 12, 14.

Although FIG. 2 only shows one face 26, it is understood that the housing includes two faces 26 each having similar passages 28 and central portions 30, such that the motor and fan blades assembly (not shown) are mountable within and fluidly communicate through the fans 12 and 14. The faces 26 have means for fixing the fan units 12, 14 such as mounting holes 34 as illustrated in the embodiment of FIG. 2. A handle 33 can be pivotally coupled between the mounting holes 34 such that the handle 33 can be stored proximate the casing and swing out to be grasped for removal of the entire fan unit assembly 10. The housing 24 is mountable between the tray bracket inlet 16 and the tray bracket outlet 18.

Referring again to FIG. 2, the tray bracket inlet 16 provides support for the fan units 12, 14, as well as means for attaching the fan unit assembly 10 to a network system device, such as a network system computer (not shown). The tray bracket inlet 16 includes a body 36 having multiple openings 38 that allow air to flow through the tray bracket inlet 16. The tray bracket inlet 16 is substantially planar in the embodiment illustrated in FIGS. 1 and 2. Alternative structural arrangements can be used in alternative embodiments. The tray bracket inlet 16 is provided with at least one tray bracket inlet coupling element, element 40 mountable on the body 36, which can have attachable clipping features, nubs and fastener openings to fasten the fan units 12, 14, and the tray bracket outlet 18 to the tray bracket inlet 16.

Figure 3:
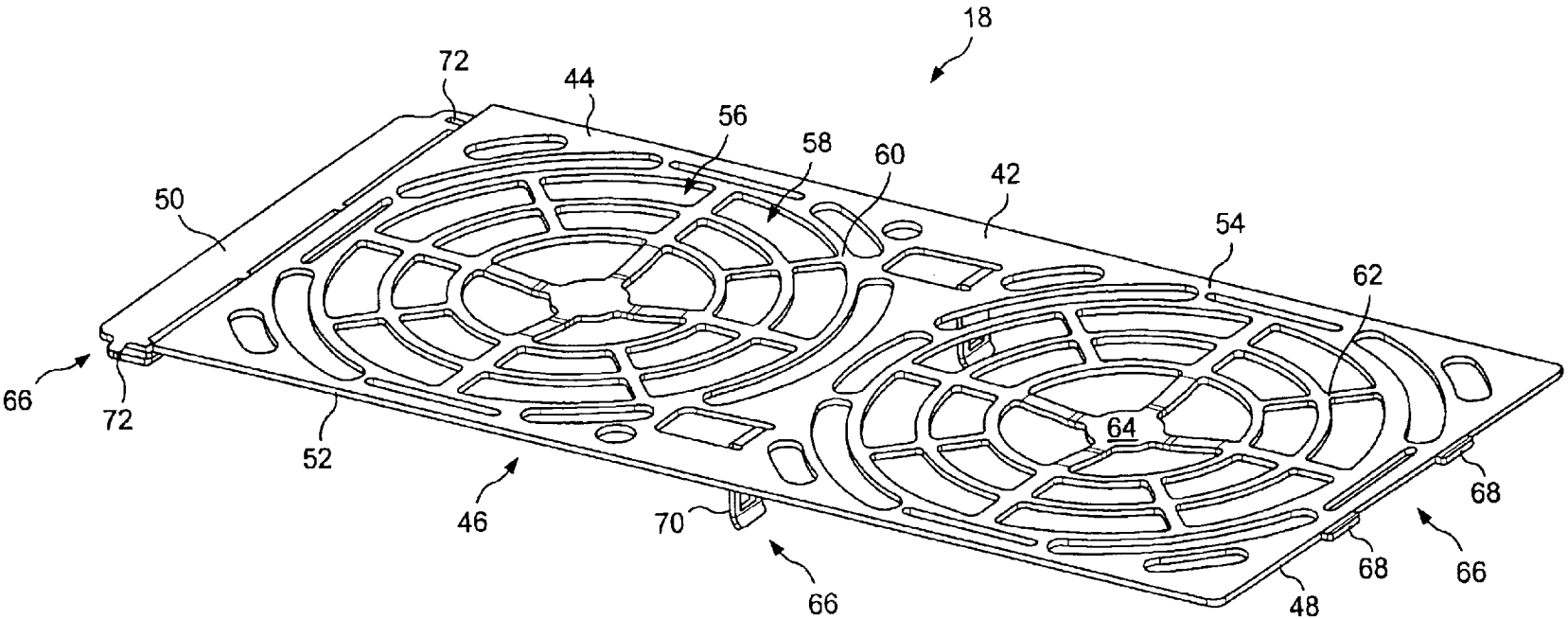
FIG. 3 is a perspective view of an exemplary tray bracket exhaust.

As illustrated in FIG. 3, the tray bracket outlet 18 includes a body 42 that is substantially planar and rectilinear in shape. Other embodiments allow for variations in planarity and the shape of the silhouette. The fan unit assembly that the tray bracket outlet is associated with can dictate the size and shape parameters of the tray bracket outlet 18. The body 42 of the tray bracket outlet 18 includes a face 44 and a back 46 located opposite thereof, making up the substantially planar surfaces of the tray bracket outlet 18. The body 42 also includes a first end 48 and a second end 50 opposite thereof. The body 42 includes a first side edge 52 and a second side edge 54 opposite thereof. The body 42 has the first end 48, the first side edge 52, the second end 50, and the second side edge 54 rimming its perimeter. The body 42 includes an outlet grill 56 having tray bracket outlet passages 58 and webbing 60 formed in the body 42. In the embodiment illustrated in FIGS. 1, 2 and 3, there are two outlet grills 56 shown side by side. The tray bracket outlet passages 58 of the outlet grill 56 can vary in shape. Some of the shapes of tray bracket outlet passages 58 can be variations of polygonal shapes such as rounded corner rectangles, rounded corner trapezoids, narrow rectangular slotted shapes, circular shapes, and the like. The webbing 60 can be linear and curved shaped members interconnected between the tray bracket outlet passages 58. The webbing 60, as illustrated in FIG. 3, can be coplanar with the body 44. In another embodiment, the webbing 60 of the outlet grill 56 can have contours that deviate from the plane that the body 42 lies in. The contours of webbing 60 can form biasing members 61 that bias the fan units 12, 14 to secure them between the tray bracket inlet 16 and the tray bracket outlet 18. The webbing 60 and the tray bracket outlet passages 58 can be arranged in a variety of patterns, including but not limited, to a web pattern 62 having a circular shape radiating outwardly away from a web center 64.

The body 44 also includes means for removably attaching the tray bracket outlet 18 to the fans 12, 14 and/or the tray bracket inlet 16 and/or first side 20 and second side 22. Attaching means 66 includes tabs 68, tray bracket outlet coupling element 70 and tab slots 72. The attaching means 66 is attachable with the tray bracket inlet coupling element, element 40 mountable on the body 36, which can have attachable clipping features and holes to fasten the tray bracket outlet 18 to the tray bracket inlet 16.

Figure 4:
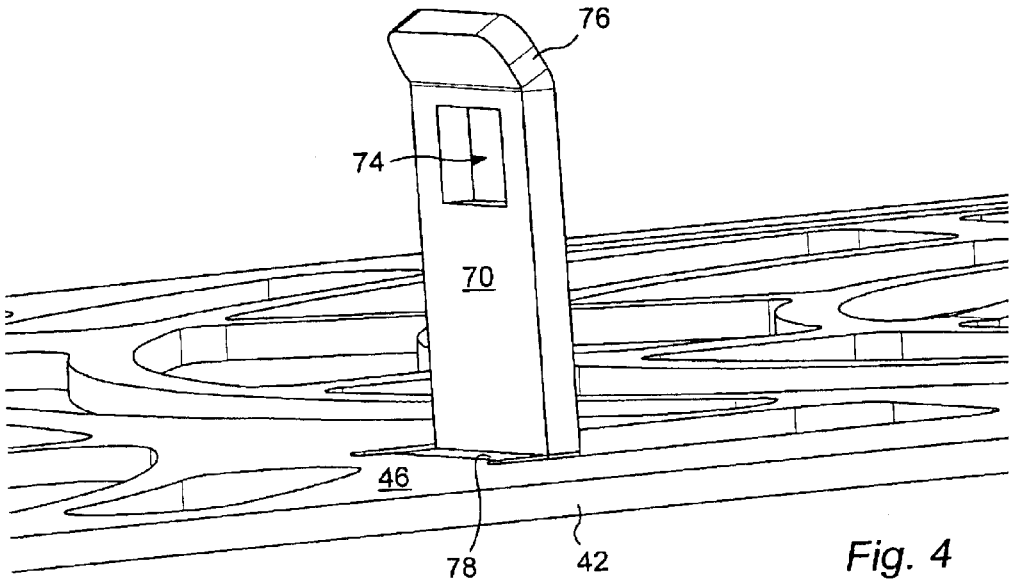
FIG. 4 is a perspective view of an exemplary coupling element.

FIG. 4 illustrates an embodiment of a tray bracket outlet coupling element 70 in more detail. The tray bracket outlet coupling element 70 is coupled to the body 42 on the back 46 such that the tray bracket outlet coupling element 70 extends outward from the back 46. The tray bracket coupling element 70 can be contiguous with the body 42 and made from the same material as the body 42. The tray bracket outlet coupling element 70 includes a cavity 74 formed in the tray bracket outlet coupling element 70. The cavity 74 is attachable with a corresponding tray bracket inlet coupling element 40 of the tray bracket inlet 16, and in another embodiment, a tab (not shown) of the fan units 12, 14. The tray bracket outlet coupling element 70 also includes a transition section 76 at an end distal from the body 42. The transition section 76 can be an angled region of the tray bracket outlet coupling element 70 that allows for coupling between the tray bracket outlet coupling element 70 and other fastening means such that binding or interference is minimized. Opposite the transition section 76 is a base section 78 of the tray bracket outlet coupling element 70. The base section 78 is proximate the body 42 on the back 46. The base section allows for flexure or biasing of the tray bracket outlet coupling element 70, such that the tray bracket outlet coupling element 70 can deflect aside and then return to a non-biased position when attaching with the tray bracket inlet coupling element 40 when assembling the fan unit assembly 10.

Figure 5:
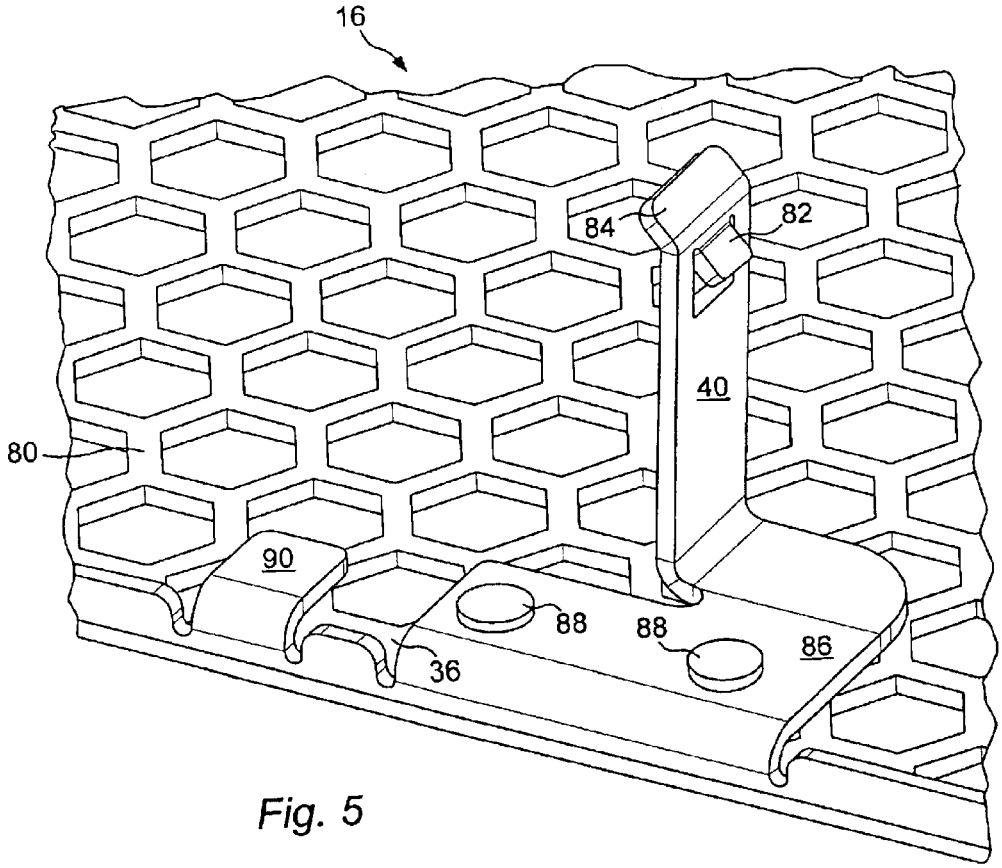
FIG. 5 is a perspective view of another exemplary coupling element.

Referring to FIG. 5 an exemplary tray bracket inlet coupling element 40 is shown. The tray bracket inlet coupling element 40 is coupled to the body 36 on a back face 80 of the tray bracket inlet 16 such that the tray bracket inlet coupling element 40 extends outward from the back 80. The tray bracket inlet coupling element 40 can also be contiguous with the body 36 and made from the same material as the body 36. The tray bracket inlet coupling element 40 includes a lock tab 82 formed in the tray bracket inlet coupling element 40. The lock tab 82 is attachable with a corresponding tray bracket outlet coupling element 70 of the tray bracket outlet 18, and in another embodiment, a tab slot (not shown) of the fan units 12, 14. The tray bracket inlet coupling element 40 also includes a transition section 84 at an end distal from the body 36. The transition section 84 can be an angled region of the tray bracket inlet coupling element 40 that allows for coupling between the tray bracket inlet coupling element 40 and other fastening means such that binding or interference is minimized. Opposite the transition section 84 is a base section 86 of the tray bracket inlet coupling element 40. The base section 86 is proximate the body 36 on the back face 80. The base section 86 allows for flexure or biasing of the tray bracket inlet coupling element 40, such that the tray bracket inlet coupling element 40 can deflect aside and then return to a non-biased position when attaching with the tray bracket outlet coupling element 70 when assembling the fan unit assembly 10. Mounting nubs 88 are disposed in the base section for securing the fan unit 12, 14. The mounting nubs 88 fit into the mounting holes 34 to demountably couple the fan units 12, 14 to the body 42 of the tray bracket inlet.

Figure 6:
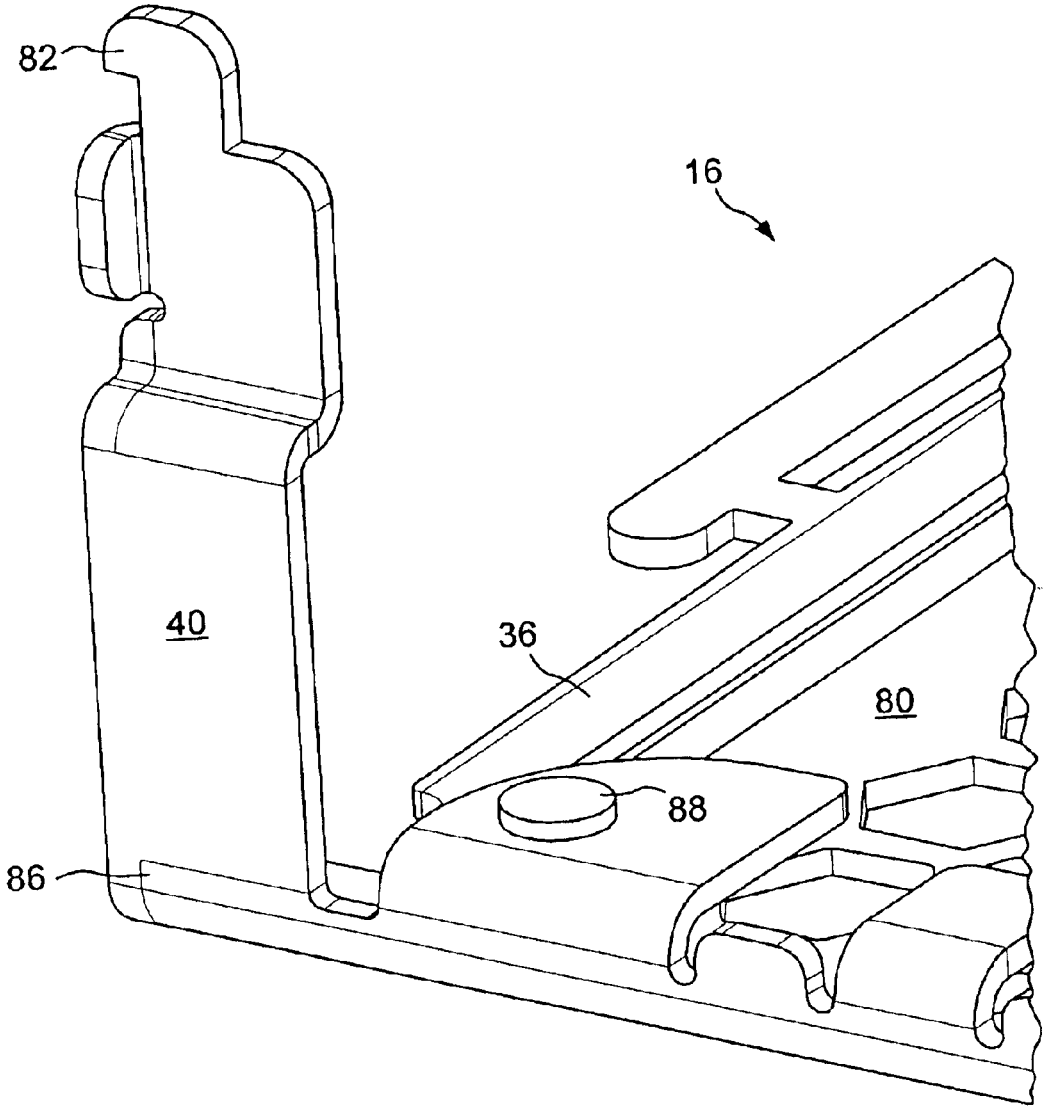
FIG. 6 is perspective view of another exemplary coupling element.

Referring to FIG. 6, another exemplary embodiment of the tray bracket inlet coupling element 40 is shown. The tray bracket inlet coupling element 40 is coupled to the body 36 on a back face 80 of the tray bracket inlet 16 such that the tray bracket inlet coupling element 40 extends outward from the back 80. The tray bracket inlet coupling element 40 includes a lock tab 82 formed in the tray bracket inlet coupling element 40. The lock tab 82 is attachable with a corresponding tray bracket outlet attaching means 66 (sown in FIG. 3) such as tab slot 72 of the tray bracket outlet 18, and in another embodiment, a tab slot (not shown) of the fan units 12, 14. The tray bracket inlet coupling element 40 also includes a base section 86 of the tray bracket inlet coupling element 40. The base section 86 is proximate the body 36 on the back face 80. The base section 86 allows for flexure or biasing of the tray bracket inlet coupling element 40, such that the tray bracket inlet coupling element 40 can deflect aside and then return to a non-biased position when attaching with the tray bracket outlet attaching means 66 when assembling the fan unit assembly 10. Mounting nubs 88 are also disposed in the base section 86 for securing the fan unit 12, 14. A wire mount 90 is defined in the body 36 along the sides of the body 36 proximate to the base section 86. The wire mount 90 secures the wiring for the fan unit 12, 14. Multiple wire mounts 90 are also defined in the body 36 in other embodiments.

Referring again to FIGS. 1, 2 and 3, the tray bracket outlet 18 is attached to the tray bracket inlet 16 and the first side 20 and second side 22 with the fan units 12 and 14 mountable inside the volume formed by the tray bracket outlet 18 attached with the tray bracket inlet 16 and the first side 20 and second side 22. The tray bracket outlet 18 aligns with the fan units 12, 14 such that air flow through the fan unit assembly 10 is optimized. The fan passages 28 and the inlet grill 56 are aligned to provide a maximum cross sectional flow area with reduced flow impedance, while maintaining protection from inserted objects into the fan unit proximate to the fan blades. Air flow impedance is the resistance to air flow through the fan unit assembly 10. A large contribution to air flow impedance or (air flow resistance or air flow loss) is the cross sectional area and the change in flow direction created by air flow around objects in the air flow path. Additionally the alignment and configuration of the fan units 12, 14, fan passages 28, and fan blades, with respect to the outlet grill 56 with tray bracket outlet passages 58 and webbing 60, is improved to maintain noise levels at or below the standards, such as ISO 7779 Acoustics—Measurement of airborne noise emitted by information technology and telecommunications equipment, and ISO 9296 Acoustics—Declared noise emission values of computer and business equipment. The tray bracket inlet 16 and the tray bracket outlet 18 also incorporate improved attaching means 66, such as the tray bracket inlet coupling elements 40, the tray bracket outlet coupling elements 70, tabs 68 and tab slots 72 are enhanced to simplify the service and maintenance of the fan unit assembly 10. Additionally, in at least one embodiment, the tray bracket outlet 18 can have an improvement in noise reduction due to the reduction of blade pass noise. Further, the fan tray bracket 15 features an enlarged flow area that can result in an increase of air flow rate of about 10% or more. The disclosed improvements may also be manufactured to be U/L listed, such that features such as the openings 38 and tray bracket outlet passages 58 meet or exceed the UL standard UL 60950 Safety of Information Technology Equipment.

While embodiments and applications of this disclosure have been illustrated and described, it would be apparent to those skilled in the art that many more modifications than mentioned above are possible without departing from the inventive concepts herein. The disclosure, therefore, is not to be restricted except in the spirit of the appended claims.

What is claimed is:

1. A fan tray bracket comprising:

tray bracket inlet, said tray bracket inlet having tray bracket inlet coupling elements;

a tray bracket outlet coupled to said tray bracket inlet, said tray bracket outlet having a body;

a plurality of tray bracket outlet passages contiguous with said body, said plurality of tray bracket outlet passages being alignable with fan passages of at least one fan unit, wherein said tray bracket outlet passages and said fan passages provide low impedance to air flow and low noise; and attaching means contiguous with said body, said attaching means being manually demountably coupled to said tray bracket inlet coupling elements;

wherein said plurality of tray bracket outlet passages form at least one web pattern, said at least one web pattern being configured to prevent insertion of finger sized objects past said at least one web pattern;

wherein said web pattern includes webbing configured to prevent insertion of finger sized objects; and wherein said body is configured substantially planar and said webbing deviates from a plane formed by said body to define a biasing member configured to bias said at least one fan unit.

2. The tray bracket of claim 1 wherein said attaching means is selected from the group consisting of tabs, tab slots and coupling elements.

3. The tray bracket of claim 1 wherein said attaching means is configured to be coupled without the use of tools.

4. The tray bracket of claim 1 wherein said attaching means is demountably coupled with a first slide and a second side.

5. The tray bracket of claim 1 wherein said fan unit includes at least one axial fan.

6. The tray bracket of claim 1 wherein said body is demountably coupled with a tray bracket inlet.

7. The tray bracket of claim 1 wherein said tray bracket outlet passages are polygonal shaped having rounded edges.

8. The tray bracket of claim 1 wherein said attaching means are removably coupled to said at least one fan unit.

9. The tray bracket of claim 1 wherein said at least one web pattern is circular shaped radiating outwardly from a web center.

10. The tray bracket of claim 9 wherein said web pattern includes multiple arc shaped rectilinear polygonal tray bracket outlet passages aligned in said circular shaped pattern.

11. A fan tray bracket comprising:

a tray bracket inlet, said tray bracket inlet having tray bracket inlet coupling elements;

a tray bracket outlet coupled to said tray bracket inlet, said tray bracket outlet having a body;

a plurality of tray bracket outlet passages contiguous with said body, said plurality of tray bracket outlet passages being alienable with fan passages of at least one fan unit, wherein said tray bracket outlet passages and said fan passages provide low impedance to air flow and low noise; and attaching means contiguous with said body, said attaching means being manually demountably coupled to said tray bracket inlet coupling elements;

wherein said body includes, a face, a back opposite thereof, a first end and a second end opposite thereof; and wherein said attaching means includes tabs defined in said first end and tab slots defined in said second end and at least one coupling element disposed on said back of said body.

12. The tray bracket of claim 11 further comprising:

two outlet grills contiguous with said body, said two outlet grills including said tray bracket outlet passages and being fluidly coupled with said fan passages wherein air flows through said fan passages into said tray bracket outlet passages with decreased flow resistance.

13. The tray bracket of claim 11 wherein said attaching means is configured to be coupled without the use of tools.

14. The tray bracket of claim 11 wherein said fan unit includes at least one axial fan.

15. The tray bracket of claim 11 wherein said body is demountably coupled with a tray bracket inlet.

16. The tray bracket of claim 11 wherein said tray bracket outlet passages are polygonal shaped having rounded edges.

17. The tray bracket of claim 11 wherein said attaching means are removably coupled to said at least one fan unit.

18. A fan unit assembly comprising:

a tray bracket outlet including tray bracket outlet passages configured to prevent finger sized objects from penetrating said tray bracket outlet passages and attaching means;

a tray bracket inlet demountably coupled to said tray bracket outlet without the use of tools;

a first side demountably coupled to said tray bracket outlet without the use of tools;

a second side contiguous with said tray bracket inlet; and at least one fan unit enclosed within said tray bracket outlet, said tray bracket, said first side and said second side, said at least one fan unit including fan passages, wherein said tray bracket outlet passages align with said fan passages minimizing air flow impedance;

wherein said first side is a printed circuit board.

19. The fan unit assembly of claim 18 wherein said tray bracket inlet includes multiple openings configured to prevent finger sized objects from penetrating said tray bracket outlet passages.

20. A fan unit assembly comprising:

a tray bracket outlet including tray bracket outlet passages configured to prevent finger sized objects from penetrating said tray bracket outlet passages and attaching means;

a tray bracket inlet demountably coupled to said tray bracket outlet without the use of tools;

a first side demountably coupled to said tray bracket outlet without the use of tools;

a second side contiguous with said tray bracket inlet; and at least one fan unit enclosed within said tray bracket outlet, said tray bracket, said first side and said second side, said at least one fan unit including fan passages, wherein said tray bracket outlet passages align with said fan passages minimizing air flow impedance;

wherein said tray bracket inlet includes at least one tray bracket inlet coupling element configured to demountably attach with said tray bracket outlet attaching means; and wherein said tray bracket coupling element includes at least one mounting nub configured to secure said at least one fan unit.

21. The fan unit assembly of claim 20 wherein said at least one tray bracket inlet coupling element and said tray bracket outlet attaching means are composed of the same material as said tray bracket outlet and said tray bracket inlet.

22. The fan unit assembly of claim 20 wherein said tray bracket inlet includes multiple openings configured to prevent finger sized objects from penetrating said tray bracket outlet passages.

* * * * *

UNITED STATES PATENT AND TRADEMARK OFFICE

CERTIFICATE OF CORRECTION

PATENT NO. : 6,783,325 B1
DATED : August 31, 2004
INVENTOR(S) : Hileman et al.

It is certified that error appears in the above-identified patent and that said Letters Patent is hereby corrected as shown below:

Column 6,
Line 35, please change “tray bracket inlet” to -- a tray bracket inlet --.

Column 7,
Line 21, please change “alienable” to -- alignable --.

Signed and Sealed this

Twenty-fifth Day of January, 2005

JON W. DUDAS
*Director of the United States Patent and Trademark Office*